US006952891B2

(12) United States Patent
Hirayama

(10) Patent No.: US 6,952,891 B2
(45) Date of Patent: Oct. 11, 2005

(54) BOOT LINER

(75) Inventor: Shuichi Hirayama, Osaka (JP)

(73) Assignee: Shimano Inc., Osaka (JP)

( * ) Notice: Subject to any disclaimer, the term of this patent is extended or adjusted under 35 U.S.C. 154(b) by 65 days.

(21) Appl. No.: 10/758,591

(22) Filed: Jan. 16, 2004

(65) Prior Publication Data

US 2004/0172848 A1 Sep. 9, 2004

(30) Foreign Application Priority Data

Feb. 7, 2003 (JP) ..... 2003-031328

(51) Int. Cl.[7] ..... A43C 11/00; A43B 5/04
(52) U.S. Cl. ..... 36/50.5; 36/10; 36/50.1
(58) Field of Search ..... 36/10, 50.1, 50.5, 36/89, 58.5, 58.6

(56) References Cited

U.S. PATENT DOCUMENTS

| | | | | |
|---|---|---|---|---|
| D385,992 | S * | 11/1997 | Brooks et al. | 36/58.5 |
| 5,924,218 | A | 7/1999 | Dalvy et al. | |
| 5,937,542 | A | 8/1999 | Bourdeau | |
| 5,992,057 | A | 11/1999 | Monti | |
| 6,052,921 | A * | 4/2000 | Oreck | 36/50.1 |
| 6,128,835 | A | 10/2000 | Ritter et al. | |
| 6,286,233 | B1 * | 9/2001 | Gaither | 36/50.1 |
| 6,467,193 | B1 | 10/2002 | Okajima | |
| 2001/0054240 | A1 | 12/2001 | Bordin et al. | |
| 2002/0129518 | A1 | 9/2002 | Borsoi et al. | |

FOREIGN PATENT DOCUMENTS

| | | | |
|---|---|---|---|
| DE | 20116617 | U1 | 3/2002 |
| EP | 1166667 | A1 | 1/2002 |
| EP | 1308104 | A | 5/2003 |
| FR | 2834182 | A | 7/2003 |
| JP | 2001-269202 | A | 10/2001 |

* cited by examiner

*Primary Examiner*—Ted Kavanaugh
(74) *Attorney, Agent, or Firm*—Shinjyu Global IP Counselors, LLP

(57) ABSTRACT

A boot liner is configured to adequately obtain a desired sensation of an upper part fitting around the ankle. The boot liner has a sole, an upper part, and a fastening mechanism. The fastening mechanism has a main strap having a first fixed strap part, a pair of movable strap parts, and a second fixed strap part. The movable strap parts extend forwardly from the ends of the first fixed strap part along the side surfaces of the upper part, and are folded back such that an insertion element through which a shoelace can be inserted is formed in the vicinity of the front ends of the upper part, and the distal ends extend through the rear portion to the side surfaces on the opposite sides of the upper part. The movable strap parts intersect each other at the rear portion and can move in relation to the upper part.

18 Claims, 3 Drawing Sheets

BOOT LINER

BACKGROUND OF THE INVENTION

1. Field of the Invention

The present invention generally relates to a boot liner. More specifically, the present invention relates to an inner boot liner for a snowboard boot.

2. Background Information

Ski boots, snowboard boots, and other such thermal footwear products generally comprise an outer boot disposed on the outside and a boot liner (inner boot) disposed on the inside of the outer boot. In most cases boot liners are configured in a shape and a material so as to provide warmth to the wearer's feet, shock absorption, good foot comfort, and the like.

Boot liners generally comprise a sole forming the bottom portion of the boot and an upper part formed extending over the top of the sole so as to cover the foot and ankle of the wearer. The upper part has a rear portion for supporting the rear section of the ankle, and a pair of side parts that support the side sections of the ankle and are integrally formed with the rear portion. In the pair of side parts, the front ends are disposed separated from each other, and a slit is formed in the front section of the ankle. A tongue for supporting the front section of the ankle is fitted extending to the top in the bottom end of the slit (for example, see U.S Pat. No. 5,924,218).

Examples of this type of conventional boot liner include those that further comprise a fastening mechanism for improving the perceived fit of the upper part on the foot. The fastening mechanism normally has a plurality of insertion elements disposed in the vicinity of the front end of the upper part at intervals in the vertical direction. Each insertion element is formed in a loop shape so that a shoelace or other such lace-shaped member can be inserted (for example, see U.S. Pat. No. 5,937,542).

In such a boot liner, for example, the ends of the shoelace are inserted in a pair of insertion elements at the same vertically aligned positions, the ends are intersected while being pulled so that the front ends move closer to each other, the operation of inserting them into adjacent insertion elements in the front end at opposite sides is repeated, and the ends are then tied together and fixed to each other, whereby the upper part is pressed against the wearer's foot, and a specific sensation of fitting is obtained.

In the above-mentioned conventional boot liner, the deformation of the upper part is limited to a condition in which the front ends merely come closer to each other when fastened to the ankle of the wearer, for which reason the sensation of fitting on the ankle is sometimes insufficient.

In view of the above, it will be apparent to those skilled in the art from this disclosure that there exists a need for an improved boot liner. This invention addresses this need in the art as well as other needs, which will become apparent to those skilled in the art from this disclosure.

SUMMARY OF THE INVENTION

One object of the present invention is to provide a boot liner wherein the sensation of the upper part fitting on the ankle can be adequately obtained.

In accordance with a first aspect of the present invention, a boot liner is provided that basically comprises a sole, an upper part, and a fastening mechanism. The upper part is coupled to the sole to extend over the sole to form a foot receiving space. The upper part includes a rear portion configured and arranged to support a rear area of a wearer's ankle, and a pair of side parts formed integrally with the rear portion to support side sections of the ankle. The side parts of the upper part both have front ends facing each other at the front of the ankle. The fastening mechanism is a mechanism that is coupled to the upper part and configured and arranged to tighten the upper part about the wearer's ankle.

The fastening mechanism comprises a main strap member. This main strap member has a first fixed strap part, a pair of movable strap parts, and a second fixed strap part. The first fixed strap part are fixed to the rear portion of the upper part and extend generally in a horizontal direction. The pair of movable strap parts extend generally forward from forward ends of the first fixed strap part along side surfaces of the upper part. The pair of movable strap parts are folded back to form a pair of insertion elements in the vicinity of the front ends of the upper part wherein lace-shaped members can be inserted. The pair of movable strap parts are moveable in relation to the upper part such that the movable strap parts extend from the insertion elements along one of the side surfaces to an opposite side of the side surfaces with the movable strap parts intersecting each other at the rear portion. The pair of second fixed strap parts are fixed to at least one of the sole and the upper part. The second fixed strap parts also extends from distal ends of the movable strap parts.

In the present invention, the words expressing directions such as top, bottom, front, rear, side, width, horizontal, and vertical indicate directions specified using the wearer's body as a standard when the wearer of the boot liner is standing in a natural posture.

When the upper part of this boot liner is fastened to the ankle, a shoelace or other such lace-shaped member, for example, is inserted in a pair of insertion elements and are pulled such that the front ends move closer to each other. The folding location of the movable strap parts then moves, and the insertion elements move farther forward in comparison with their positions before the fastening operation. Then, the sections of the movable strap parts extending from the insertion elements to the rear are pulled toward the insertion elements, and the rearward section of the upper part is deformed.

This deformation causes the upper part to be firmly pressed against the ankle of the wearer, and a stronger sensation of the upper part fitting to the ankle can be felt in comparison with a case in which the upper part is deformed such that the front ends merely move closer to each other.

A particular feature of this boot liner is that the rear section of the upper part can be more firmly pressed against the ankle of the wearer because the movable strap parts intersect at the back of the upper part, and thus a sensation of a comfortable fit is obtained.

In accordance with a second aspect of the present invention, the boot liner of the first aspect of the present invention is configured such that the movable strap parts intersect each other at the rear area of the wearer's ankle that is adjacent to a top of a heel. With this boot liner, the upper part is effectively fitted to the ankle of the wearer during fastening because the upper part is deformed such that the rear portion is pressed against the very top section of the heel of the wearer.

In accordance with a third aspect of the present invention, the boot liner of the first and/or second aspects of the present invention is configured such that it further comprises a rear support. The rear support of the upper part includes a vertically extending rear support having a restraint section and a release section. The restraint is provided at the rear portion of the upper part. The restraint section is configured and arranged to restrain the first fixed strap part of the main strap member to prevent movement in relation to the rear portion of the upper part. The release section is configured and arranged to moveble retain of the movable strap parts of the main strap member in relation to the upper part. Thus, the rear support is designed for restraining the first fixed strap part of the main strap member to prevent movement in relation to the rear portion and to allow movement of the movable strap parts of the main strap member in relation to the upper part. With this boot liner, the effects of fastening the upper part with the movable strap parts can be adequately obtained because the movable strap parts can move freely without being constrained by the rear support.

In accordance with a fourth aspect of the present invention, the boot liner in any one of the first through third aspects of the present invention is configured such that the first fixed strap part of the main strap member is fixed to and extends horizontally from the rear portion of the upper part to the horizontally central section of the side part. In this boot liner, the movable strap parts can move in relation to the upper part only in the front side section, rather than in the central section of the side part. Limiting the range of movement of the movable strap parts in this manner makes it possible for the upper part to be locally deformed in the rear section, and the perceived fit in the rear section of the ankle to be enhanced.

In accordance with a fifth aspect of the present invention, the boot liner in any one of the first through fourth aspects of the present invention is configured such that the fastening mechanism further comprises an upper auxiliary strap member and a lower auxiliary strap member. The upper auxiliary strap member is coupled to the upper part to form a pair of upper insertion elements near the front ends of the upper part at locations above the insertion elements of the main strap member. The lower auxiliary strap member is coupled to the upper part to form a pair of lower insertion elements near the front ends of the upper part at locations below the insertion elements of the main strap member. In this boot liner, lace-shaped members can also be inserted through the insertion elements of the auxiliary strap members, thus allowing the upper part to be fastened in the vertical direction over a wide range, and the perceived fit on the ankle to be enhanced.

In accordance with a sixth aspect of the present invention, the boot liner in any one of the fifth aspect of the present invention is configured such that the movable strap parts of the main strap member are restrained to be immobile in relation to the upper part in a vicinity of the sole by the lower auxiliary strap member positioned below the main strap member. In this boot liner, restraining the main strap member in the vicinity of the sole of the upper part by the auxiliary strap members makes it possible, for example, to overcome shortcomings whereby the movable strap parts are twisted or the inner walls of the outer boot are stretched when the boot liner is inserted into the outer boot.

In accordance with a seventh aspect of the present invention, the boot liner of the fifth and/or sixth aspects of the present invention is configured such that the upper and lower auxiliary strap members are fixedly coupled to the upper part along their lengths, except for areas near the front ends of the upper part. In this boot liner, the auxiliary strap members do not have movable strap parts in the same way as the main strap member does, so the upper part can be fastened such that the front ends are merely moved closer to each other during fastening. Consequently, the fastening effect from the main strap member can be enhanced in relative fashion, and the wearer can clearly feel the fastening effect in the base section of the ankle.

In accordance with an eighth aspect of the present invention, the boot liner in any one of the first through seventh aspects of the present invention is configured such that the insertion elements are formed behind the front ends. In this boot liner, the extreme back sections of the front ends can be stretched when the upper part is fastened, making it possible to bring the front ends closer to each other in an efficient manner.

In accordance with a ninth aspect of the present invention, the boot liner in any one of the first through eighth aspects of the present invention is configured such that the sole and the upper part are configured and arranged to form an inner boot liner of a snowboard boot having an outer boot. In this boot liner, the wearer can have the sensation of a comfortable fit, particularly when the boot liner is used as an inner boot liner for a snowboard boot.

According to the present invention, the upper part is strongly pressed against the ankle of the wearer by a main strap member that has movable strap parts, and the sensation of the upper part fitting to the ankle can be felt more clearly compared with cases in which the upper part is merely deformed to move the front ends closer to each other.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
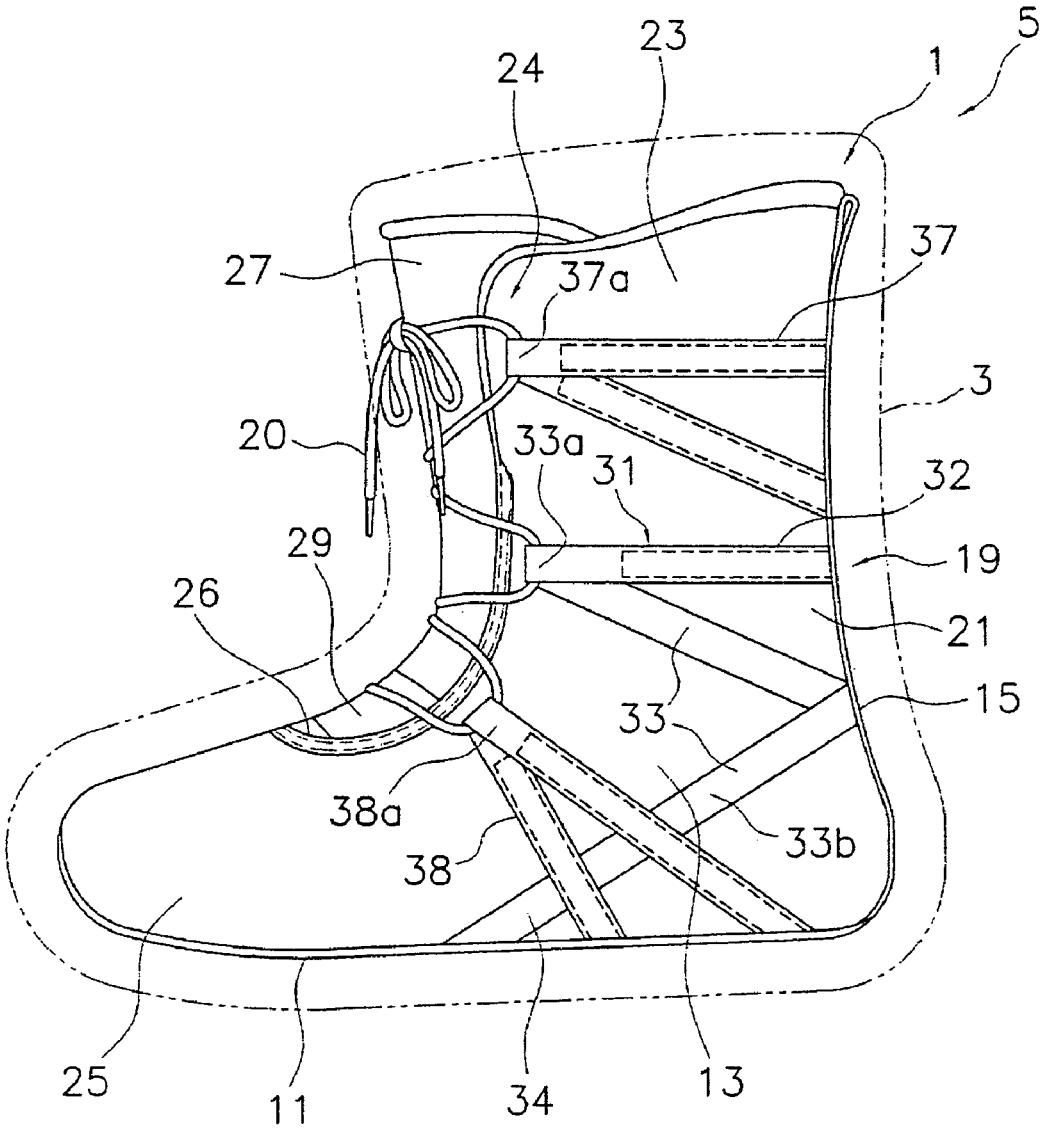
FIG. 1 is a side elevational view of a boot liner in accordance with one embodiment of the present invention.
Figure 2:
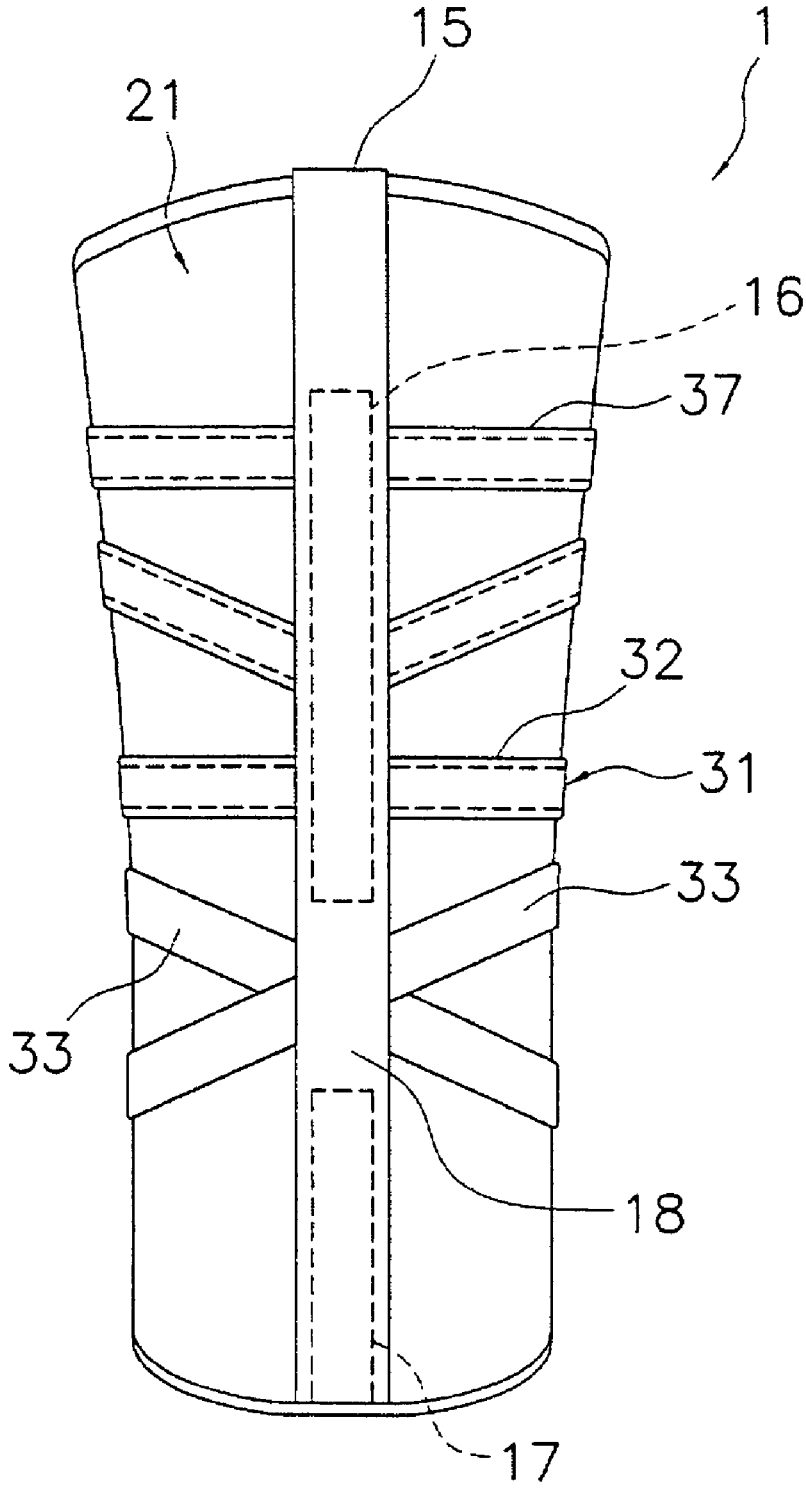
FIG. 2 is a rear elevational view of the boot liner illustrated in FIG. 1 in accordance with the present invention.
Figure 3:
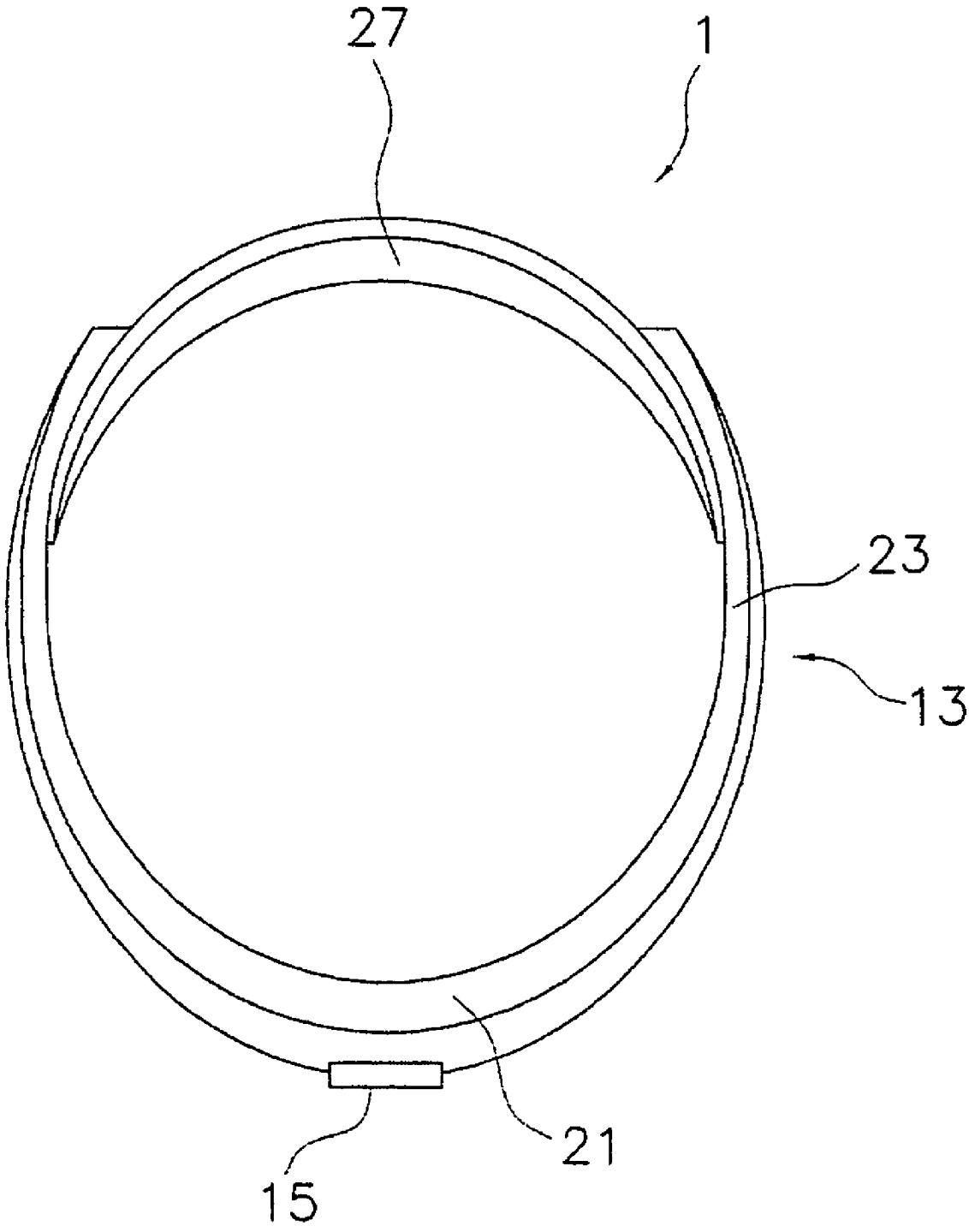
FIG. 3 is a top plan view of the boot liner illustrated in FIGS. 1 and 2 in accordance with the present invention.

Referring to FIGS. 1–3, a boot liner 1 is illustrated in accordance with a first embodiment of the present invention. This boot liner 1 is an inner boot liner that is disposed inside an outer boot 3 of a snowboard boot 5. The boot liner 1 basically comprises a sole 11, an upper part 13, a rear support 15, and a fastening mechanism 19. The outer boot 3 is the same as a conventional outer boot and thus will not be discussed or illustrated in detail herein.

The sole 11 is the section forming the bottom section of the boot liner 1. Thus, the sole 11 has a generally foot shaped outline or peripheral edge. The peripheral edge of the sole 11 is sewn into or bonded to the lower end or edge of the upper part 13. The sole 11 is configured and arranged to have a specific cushioning effect. Preferably, the sole 11 is configured to have an outer sole portion and an inner sole portion (neither is shown) in which the outer sole portion is sewn into the upper part 13 and the inner sole portion is layered and detachably disposed on top of the outer sole portion.

The upper part 13 is a section formed into a shape to extend upwardly and over the sole 11 to form a foot receiving space to cover the foot and ankle of the wearer. The upper part 13 has a rear portion 21, a pair of side parts 23, a front part 25, and a tongue 27. The rear portion 21, the side parts 23, the front part 25, and the tongue 27 are all configured from materials and in shapes that allow adequate heat retention and an adequate perceived fit to be obtained.

The rear portion 21 is a section forming the rear section of the upper part 13, and this part supports the rear section of the wearer's ankle.

The side parts 23 are sections forming the side sections on both sides of the upper part 13. The side parts 23 are integrally formed with the rear portion 21 as a one-piece, unitary member. The side parts 23 support the side sections of the wearer's ankle. Also, the front ends 24 of the side parts 23 are disposed to face each other at the front of the ankle, and form a slit 26 together with the front part 25. A rubber band 29 for pressing the tongue 27 against the ankle of the wearer is mounted extending in the width direction at the bottom section of the slit 26.

The front part 25 is a section forming the front section of the upper part 13, and is integrally formed with the side parts 23 and the rear portion 21 as a one-piece, unitary member. The front part 25 is formed into a shape so as to cover the tip of the wearer's foot.

The tongue 27 is a section provided to cover the slit 26. The tongue 27 is a separate element from the other sections 21, 23, and 25, and only the bottom end of the tongue 27 is sewn onto the section of the front part 25 forming the slit 26. The tongue 27 supports the front section of the wearer's ankle.

As shown in FIG. 2, the rear support 15 is a belt-shaped member extending vertically over the surface of the rear portion 21 in a direction perpendicular to the sole 11. The rear support 15 has a pair of restraint sections 16 and 17 formed by the rear support 15 being sewn into the rear portion 21, and a release section 18 that is not sewn onto the rear portion 21. In FIGS. 1 and 2, the dotted lines on the rear support 15 and the straps 31, 37, and 38 (described later) indicate stitching where the rear support 15 and the straps 31, 37, and 38 are sewn to the upper part 13.

The restraint section 16 is a section sewn from a vertically central part of the rear portion 21 to a top part of the rear portion 21, while the restraint section 17 is a section sewn into a bottom section of the rear portion 21. Here the restraint section 16 is overlapped on and sewn to a first fixed strap part 32 (described later) of a main strap 31 sewn into the rear portion 21. Thus, the restraint section 16 restrains the first fixed strap part 32 from moving in relation to the upper part 13.

The release section 18 is formed at a position corresponding to the section adjacent to the top of the wearer's heel (or the rear section of the ankle). The release section 18 is disposed such that two movable strap parts 33 (described later) of the main strap 31 intersect each other between the release section 18 and the rear portion 21. The movable strap parts 33 are made immobile in relation to the rear portion 21. The area at which the two movable strap parts 33 intersect each other is constrained from moving vertically by the restraints 16 and 17.

The fastening mechanism 19 is a mechanism for fastening the upper part 13 such that the upper part 13 fits to the ankle of the wearer, and the mechanism comprises the main strap 31 and two support straps 37 and 38.

The main strap 31 is a belt-shaped member disposed at the vertically central section of the upper part 13. The main strap 31 includes the first fixed strap part 32, the two movable strap parts 33, and a pair of second fixed strap parts 34, all formed integrally with each other as a one-piece, unitary strap.

The first fixed strap part 32 is a section extending horizontally between the horizontally central parts of the side parts 23 and around the rear portion 21. The first fixed strap part 32 is sewn into the upper part 13 so as to be stationary. Preferably, the two length of the first fixed strap part 32 is sewn to the upper part 13. While only one side of the boot liner 1 is shown in FIG. 1, it will be apparent from this disclosure that the opposite side of the boot liner 1 has the same configuration. In other words, if the opposite side of the boot liner 1 was illustrated, it would be a mirror image of FIG. 1.

The two movable strap parts 33 are two sections of the main strap 31, with each of the two movable strap parts 33 including a horizontal section extending from one end of the first fixed strap part 32 and a diagonal section extending diagonally downward from one side of the boot liner 1, around the rear end of the boot liner 1, to the second fixed strap part 34 at the opposite side of the boot liner 1. More specifically, the movable strap parts 33 are disposed to first extend forwardly in a horizontal direction from the forward ends of the first fixed strap part 32 along the surfaces of the side parts 23, then folding at a position slightly behind the front ends 24, and finally slanting rearwardly and downwardly to the sole 11.

Thus, two movable strap parts 33 forms a pair of centrally located insertion element 33*a* at one end and a pair of distal ends 33*b* fixed to the sole 11 by the second fixed strap parts 34. The distal ends 33*b* extend along the surface of the rear portion 21 to the bottom sections of the side parts 23 on opposite sides. The movable strap parts 33 bend back behind the front ends 24 so that the insertion element 33*a* is formed through which the shoelace 20 or other such lace-shaped member can be inserted. The movable part 33 is not sewn into the upper part 13 and can move in relation to the upper part 13.

The second fixed strap parts 34 are sections extending from the distal ends 33*b* of the movable strap parts 33 to the sole 11, with the free ends are fixed to the sole 11. Also, the second fixed strap parts 34 are each restrained and kept immobile in relation to the upper part 13 by being superposed and sewn into an area near the sole 11 by a sub-strap 38 disposed at the bottom of the main strap 31.

The sub-straps 37 and 38 are belt-shaped sections similar to the main strap 31. The sub-strap 37 is disposed above the main strap 31 while the sub-strap 38 is disposed below the main strap 31.

The sub-strap 37 is disposed extending from the rear portion 21 to the front along the surfaces of the side parts 23, folding at a position slightly behind the front ends 24, and slanting back to extend down to the rear portion 21. An insertion element 37*a* through which the shoelace 20 or the like can be inserted is formed in the folding area of the sub-strap 37. All of the sections of the sub-strap 37 are sewn into the upper part 13, except for the section in which the insertion element 37*a* is formed.

The sub-strap 38 is disposed extending from both sides of the rear section of the sole 11 along the surfaces of the side parts 23 slanting forward to the top, and folding at a position slightly behind the front ends 24 to extend down to the longitudinally central section of the sole 11. An insertion element 38*a* through which the shoelace 20 or the like can be inserted is formed in the folding area of the sub-strap 38. Similar to the sub-strap 37, all of the sections of the sub-strap 38 are sewn into the upper part 13, except for the section in which the insertion element 38*a* is formed.

When the boot liner 1 thus configured is to be fitted to the foot of the wearer, as shown in FIG. 1, the shoelace 20 is inserted in advance through the insertion elements 38*a*, 37*a*, and 33*a* in the order indicated. In this state, the foot is then inserted into the boot liner 1, and the shoelace 20 is pulled so that the front ends 24 of the upper part 13 move closer to each other. Then the sub-straps 37 and 38 in the top and bottom sections of the upper part 13 are pulled forward by using the insertion elements 37*a* and 38*a*, whereby the upper part 13 is deformed so that the opposing front ends 24 move closer to each other, and a sensation of a specific fit is created.

Conversely, the folding position of the main strap 31 in the vertically central section of the upper part 13 moves forward, and the insertion element 33*a* moves farther forward in comparison with its position before the fastening operation. The sections of the movable strap parts 33 extending back from the insertion element 33*a* to the rear are then pulled toward the insertion element 33*a*, and the rearward section of the upper part 13 is deformed. This deformation causes the upper part 13 to be firmly pressed against the area of the wearer's ankle, allowing the wearer to clearly feel a sensation of the upper part 13 fitting to the ankle.

A particular feature of this boot liner 1 is that the rear section of the upper part 13 can be more firmly pressed against the ankle of the wearer because the movable strap parts 33 intersect at the back of the upper part 13, and thus a sensation of a comfortable fit is obtained.

OTHER EMBODIMENTS

The boot liner can be used not only as an inner boot liner for snowboarding, but also in other footwear products having an outer boot (including an outer shell whose surface section is configured from hardened material), such as a ski boot or a hiking boot. The number of sub-straps, arrangement and position of parts, and the like can be modified as necessary.

As used herein, the following directional terms "forward, rearward, above, downward, vertical, horizontal, below and transverse" as well as any other similar directional terms refer to those directions of a boot liner in its normal use position. Accordingly, these terms, as utilized to describe the present invention should be interpreted relative to a boot liner in its normal use position. Moreover, the terms of degree such as "substantially", "about" and "approximately" as used herein mean a reasonable amount of deviation of the modified term such that the end result is not significantly changed. These terms should be construed as including a deviation of at least ±5% of the modified term if this deviation would not negate the meaning of the word it modifies.

This application claims priority to Japanese Patent Application No. 2003-031328. The entire disclosure of Japanese Patent Application No. 2003-031328 is hereby incorporated herein by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A boot liner comprising:

a sole;

an upper part coupled to the sole to extend over the sole to form a foot receiving space, the upper part including a rear portion configured and arranged to support a rear area of a wearer's ankle, and a pair of side parts formed integrally with the rear portion to support side sections of the ankle, the side parts of the upper part both having front ends facing each other at the front of the ankle; and a fastening mechanism coupled to the upper part and configured and arranged to tighten the upper part about the wearer's ankle, and the fastening mechanism having a main strap member comprising a first fixed strap part fixed to the rear portion of the upper part and extending generally in a horizontal direction, a pair of movable strap parts extending generally forward from forward ends of the first fixed strap part along side surfaces of the upper part, the movable strap parts being folded back to form a pair of insertion elements in the vicinity of the front ends of the upper part, and the movable strap parts being moveable in relation to the upper part such that the movable strap parts extend from the insertion elements along one of the side surfaces to an opposite side of the side surfaces with the movable strap parts intersecting each other at the rear portion, and a pair of second fixed strap parts fixed to at least one of the sole and the upper part, the second fixed strap parts extending from distal ends of the movable strap parts.

2. The boot liner according to claim 1, wherein the movable strap parts are configured and arranged to intersect each other at the rear area of the wearer's ankle that is adjacent to a top of a heel.

3. The boot liner according to claim 2, wherein the rear portion of the upper part includes a vertically extending rear support having a restraint section and a release section, the restraint section being configured and arranged to restrain the first fixed strap part of the main strap member to prevent movement in relation to the rear portion of the upper part, and the release section being configured and arranged to moveble retain of the movable strap parts of the main strap member in relation to the upper part.

4. The boot liner according to claims 3, wherein the first fixed strap part of the main strap member is fixed to and extends horizontally from the rear portion of the upper part to horizontally central sections of the side parts.

5. The boot liner according to claims 4, wherein the fastening mechanism further comprises an upper auxiliary strap member coupled to the upper part to form a pair of upper insertion elements near the front ends of the upper part at locations above the insertion elements of the main strap member; and the fastening mechanism further comprises a lower auxiliary strap member coupled to the upper part to form a pair of lower insertion elements near the front ends of the upper part at locations below the insertion elements of the main strap member.

6. The boot liner according to claim 5, wherein the movable strap parts of the main strap member are restrained to be immobile in relation to the upper part in a vicinity of the sole by the lower auxiliary strap member positioned below the main strap member.

7. The boot liner according to claim 6, wherein the upper and lower auxiliary strap members are fixedly coupled to the upper part along their lengths, except for areas near the front ends of the upper part.

8. The boot liner according to claim 5, wherein the upper and lower auxiliary strap members are fixedly coupled to the upper part along their lengths, except for areas near the front ends of the upper part.

9. The boot liner according to claim 5, wherein the insertion elements are formed behind the front ends.

10. The boot liner according to claim 5, wherein the sole and the upper part are configured and arranged to form an inner boot liner of a snowboard boot having an outer boot.

11. The boot liner according to claim 1, wherein the rear portion of the upper part includes a vertically extending rear support having a restraint section and a release section, the restraint section being configured and arranged to restrain the first fixed strap part of the main strap member to prevent movement in relation to the rear portion of the upper part, and the release section being configured and arranged to moveble retain of the movable strap parts of the main strap member in relation to the upper part.

12. The boot liner according to claim 1, wherein the first fixed strap part of the main strap member is fixed to and extends horizontally from the rear portion of the upper part to horizontally central sections of the side parts.

13. The boot liner according to claim 1, wherein the fastening mechanism further comprises an upper auxiliary strap member coupled to the upper part to form a pair of upper insertion elements near the front ends of the upper part at locations above the insertion elements of the main strap member; and the fastening mechanism further comprises a lower auxiliary strap member coupled to the upper part to form a pair of lower insertion elements near the front ends of the upper part at locations below the insertion elements of the main strap member.

14. The boot liner according to claim 13, wherein the movable strap parts of the main strap member are restrained to be immobile in relation to the upper part in a vicinity of the sole by the lower auxiliary strap member positioned below the main strap member.

15. The boot liner according to claim 14, wherein the upper and lower auxiliary strap members are fixedly coupled to the upper part along their lengths, except for areas near the front ends of the upper part.

16. The boot liner according to claim 13, wherein the upper and lower auxiliary strap members are fixedly coupled to the upper part along their lengths, except for areas near the front ends of the upper part.

17. The boot liner according to claim 13, wherein the insertion elements are formed behind the front ends.

18. The boot liner according to claim 1, wherein the sole and the upper part are configured and arranged to form an inner boot liner of a snowboard boot having an outer boot.

* * * * *